US010883058B2

(12) United States Patent
Shafi et al.

(10) Patent No.: US 10,883,058 B2
(45) **Date of Patent: *Jan. 5, 2021**

(54) INTEGRATED HYDROTREATING AND STEAM PYROLYSIS PROCESS INCLUDING RESIDUAL BYPASS FOR DIRECT PROCESSING OF A CRUDE OIL

(71) Applicant: Saudi Arabian Oil Company, Dhahran (SA)

(72) Inventors: Raheel Shafi, Manama (BH); Abdennour Bourane, Ras Tanura (SA); Essam Sayed, Dhahran (SA); Ibrahim A. Abba, Dhahran (SA); Abdul Rahman Zafer Akhras, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 16/504,722

(22) Filed: Jul. 8, 2019

(65) Prior Publication Data

US 2019/0390125 A1 Dec. 26, 2019

Related U.S. Application Data

(60) Continuation of application No. 15/933,655, filed on Mar. 23, 2018, now Pat. No. 10,344,227, which is a division of application No. 15/082,362, filed on Mar. 28, 2016, now abandoned, which is a continuation of application No. 13/865,060, filed on Apr. 17, 2013, now Pat. No. 9,296,961, which is a continuation-in-part of application No. PCT/US2013/023337, filed on Jan. 27, 2013.

(60) Provisional application No. 61/790,519, filed on Mar. 15, 2013, provisional application No. 61/591,816, filed on Jan. 27, 2012.

(51) Int. Cl.

| | |
|---|---|
| ***C10G 69/06*** | (2006.01) |
| ***C10G 45/00*** | (2006.01) |
| ***C10G 9/36*** | (2006.01) |

(52) U.S. Cl.

CPC ..... *C10G 69/06* (2013.01); *C10G 9/36* (2013.01); *C10G 45/00* (2013.01); *C10G 2300/201* (2013.01); *C10G 2300/308* (2013.01); *C10G 2300/4081* (2013.01); *C10G 2400/20* (2013.01); *C10G 2400/30* (2013.01)

(58) Field of Classification Search

None

See application file for complete search history.

(56) References Cited

U.S. PATENT DOCUMENTS

| | | | | |
|---|---|---|---|---|
| 3,842,138 | A | 10/1974 | Chahvekilan et al. | |
| 3,944,481 | A | 3/1976 | Wing et al. | |
| 4,002,556 | A | 1/1977 | Satchell | |
| 4,065,379 | A | 12/1977 | Soonawala et al. | |
| 4,115,467 | A * | 9/1978 | Fowler | C07C 4/02 208/107 |
| 4,180,453 | A | 12/1979 | Franck et al. | |

(Continued)

*Primary Examiner* — Derek N Mueller

(74) *Attorney, Agent, or Firm* — Abelman, Frayne and Schwab

(57) ABSTRACT

A process is provided that is directed to integrated steam pyrolysis and hydroprocessing including residual bypass to permit direct processing of crude oil feedstocks to produce petrochemicals including olefins and aromatics.

14 Claims, 3 Drawing Sheets

(56) References Cited

U.S. PATENT DOCUMENTS

| | | | | |
|---|---|---|---|---|
| 4,798,665 | A | 1/1989 | Humbach et al. | |
| 5,192,421 | A | 3/1993 | Audeh et al. | |
| 5,258,117 | A | 11/1993 | Kolstad et al. | |
| 5,906,728 | A | 5/1999 | Iaccino et al. | |
| 6,177,600 | B1 * | 1/2001 | Netzer | C07C 11/04 585/323 |
| 6,190,533 | B1 | 2/2001 | Bradow et al. | |
| 6,210,561 | B1 | 4/2001 | Bradow et al. | |
| 6,303,842 | B1 | 10/2001 | Bridges et al. | |
| 6,632,351 | B1 | 10/2003 | Ngan et al. | |
| 7,220,887 | B2 | 5/2007 | Stell et al. | |
| 7,311,746 | B2 | 12/2007 | Stell et al. | |
| 7,408,093 | B2 | 8/2008 | Stell et al. | |
| 7,951,745 | B2 | 5/2011 | Zhou et al. | |
| 7,972,498 | B2 | 7/2011 | Buchanan et al. | |
| 8,070,938 | B2 | 12/2011 | Stein et al. | |
| 8,071,833 | B2 | 12/2011 | Grootjans et al. | |
| 9,296,961 | B2 * | 3/2016 | Shafi | C10G 45/00 |
| 2004/0004028 | A1 | 1/2004 | Stell et al. | |
| 2004/0054247 | A1 | 3/2004 | Powers et al. | |
| 2005/0261530 | A1 | 11/2005 | Stell et al. | |
| 2007/0090018 | A1 * | 4/2007 | Keusenkothen | C10G 9/007 208/106 |
| 2007/0090020 | A1 | 4/2007 | Buchanan et al. | |
| 2007/0232846 | A1 | 10/2007 | Baumgartner et al. | |
| 2010/0087692 | A1 | 4/2010 | Yoshimura et al. | |
| 2011/0042269 | A1 | 2/2011 | Kuechler et al. | |
| 2011/0174682 | A1 | 7/2011 | Iaccino | |
| 2011/0247500 | A1 | 10/2011 | Akhras et al. | |
| 2013/0046122 | A1 | 2/2013 | Vermeiren et al. | |

* cited by examiner

INTEGRATED HYDROTREATING AND STEAM PYROLYSIS PROCESS INCLUDING RESIDUAL BYPASS FOR DIRECT PROCESSING OF A CRUDE OIL

RELATED APPLICATIONS

This application is a continuation application of U.S. patent application Ser. No. 15/933,655 filed on Mar. 23, 2018, which is a divisional application of U.S. patent application Ser. No. 15/082,362 filed on Mar. 28, 2016, which is a continuation application of U.S. patent application Ser. No. 13/865,060 filed on Apr. 17, 2013, now U.S. Pat. No. 9,296,961 issued on Mar. 29, 2016, which

- claims the benefit of priority under 35 USC § 119(e) to U.S. Provisional Patent Application No. 61/790,519 filed Mar. 15, 2013, and
- is a Continuation-in-Part under 35 USC § 365(c) of PCT Patent Application No. PCT/US13/23337 filed Jan. 27, 2013, which claims the benefit of priority under 35 USC § 119(e) to U.S. Provisional Patent Application No. 61/591,816 filed Jan. 27, 2012, all of which are incorporated herein by reference in their entireties.

BACKGROUND OF THE INVENTION

Field of the Invention

The present invention relates to an integrated hydrotreating and steam pyrolysis process for direct processing of a crude oil to produce petrochemicals such as olefins and aromatics.

Description of Related Art

The lower olefins (i.e., ethylene, propylene, butylene and butadiene) and aromatics (i.e., benzene, toluene and xylene) are basic intermediates which are widely used in the petrochemical and chemical industries. Thermal cracking, or steam pyrolysis, is a major type of process for forming these materials, typically in the presence of steam, and in the absence of oxygen. Feedstocks for steam pyrolysis can include petroleum gases and distillates such as naphtha, kerosene and gas oil. The availability of these feedstocks is usually limited and requires costly and energy-intensive process steps in a crude oil refinery.

Studies have been conducted using heavy hydrocarbons as a feedstock for steam pyrolysis reactors. A major drawback in conventional heavy hydrocarbon pyrolysis operations is coke formation. For example, a steam cracking process for heavy liquid hydrocarbons is disclosed in U.S. Pat. No. 4,217,204 in which a mist of molten salt is introduced into a steam cracking reaction zone in an effort to minimize coke formation. In one example using Arabian light crude oil having a Conradson carbon residue of 3.1% by weight, the cracking apparatus was able to continue operating for 624 hours in the presence of molten salt. In a comparative example without the addition of molten salt, the steam cracking reactor became clogged and inoperable after just 5 hours because of the formation of coke in the reactor.

In addition, the yields and distributions of olefins and aromatics using heavy hydrocarbons as a feedstock for a steam pyrolysis reactor are different than those using light hydrocarbon feedstocks. Heavy hydrocarbons have a higher content of aromatics than light hydrocarbons, as indicated by a higher Bureau of Mines Correlation Index (BMCI). BMCI is a measurement of aromaticity of a feedstock and is calculated as follows:

$$BMCI=87552/VAPB+473.5*(sp.\ gr.)-456.8 \quad (1)$$

where:

VAPB=Volume Average Boiling Point in degrees Rankine and sp. gr.=specific gravity of the feedstock.

As the BMCI decreases, ethylene yields are expected to increase. Therefore, highly paraffinic or low aromatic feeds are usually preferred for steam pyrolysis to obtain higher yields of desired olefins and to avoid higher undesirable products and coke formation in the reactor coil section.

The absolute coke formation rates in a steam cracker have been reported by Cai et al., "Coke Formation in Steam Crackers for Ethylene Production," *Chem. Eng. & Proc.*, vol. 41, (2002), 199-214. In general, the absolute coke formation rates are in the ascending order of olefins>aromatics>paraffins, wherein olefins represent heavy olefins To be able to respond to the growing demand of these petrochemicals, other type of feeds which can be made available in larger quantities, such as raw crude oil, are attractive to producers. Using crude oil feeds will minimize or eliminate the likelihood of the refinery being a bottleneck in the production of these petrochemicals.

While the steam pyrolysis process is well developed and suitable for its intended purposes, the choice of feedstocks has been very limited.

SUMMARY OF THE INVENTION

The system and process herein provides a steam pyrolysis zone integrated with a hydroprocessing zone including residual bypass to permit direct processing of crude oil feedstocks to produce petrochemicals including olefins and aromatics.

The integrated hydrotreating and steam pyrolysis process for the direct processing of a crude oil to produce olefinic and aromatic petrochemicals comprises separating the crude oil into light components and heavy components; charging the light components and hydrogen to a hydroprocessing zone operating under conditions effective to produce a hydroprocessed effluent having a reduced content of contaminants, an increased paraffinicity, reduced Bureau of Mines Correlation Index, and an increased American Petroleum Institute gravity; thermally cracking the hydroprocessed effluent in the presence of steam to produce a mixed product stream; separating the mixed product stream; purifying hydrogen recovered from the mixed product stream and recycling it to the hydroprocessing zone; recovering olefins and aromatics from the separated mixed product stream; and recovering a combined stream of pyrolysis fuel oil from the separated mixed product stream and heavy components from step (a) as a fuel oil blend.

As used herein, the term "crude oil" is to be understood to include whole crude oil from conventional sources, including crude oil that has undergone some pre-treatment. The term crude oil will also be understood to include that which has been subjected to water-oil separation; and/or gas-oil separation; and/or desalting; and/or stabilization.

Other aspects, embodiments, and advantages of the process of the present invention are discussed in detail below. Moreover, it is to be understood that both the foregoing information and the following detailed description are merely illustrative examples of various aspects and embodiments, and are intended to provide an overview or framework for understanding the nature and character of the claimed features and embodiments. The accompanying drawings are illustrative and are provided to further the understanding of the various aspects and embodiments of the process of the invention.

BRIEF DESCRIPTION OF THE DRAWINGS

The invention will be described in further detail below and with reference to the attached drawings where.

DETAILED DESCRIPTION OF THE INVENTION

Figure 1:
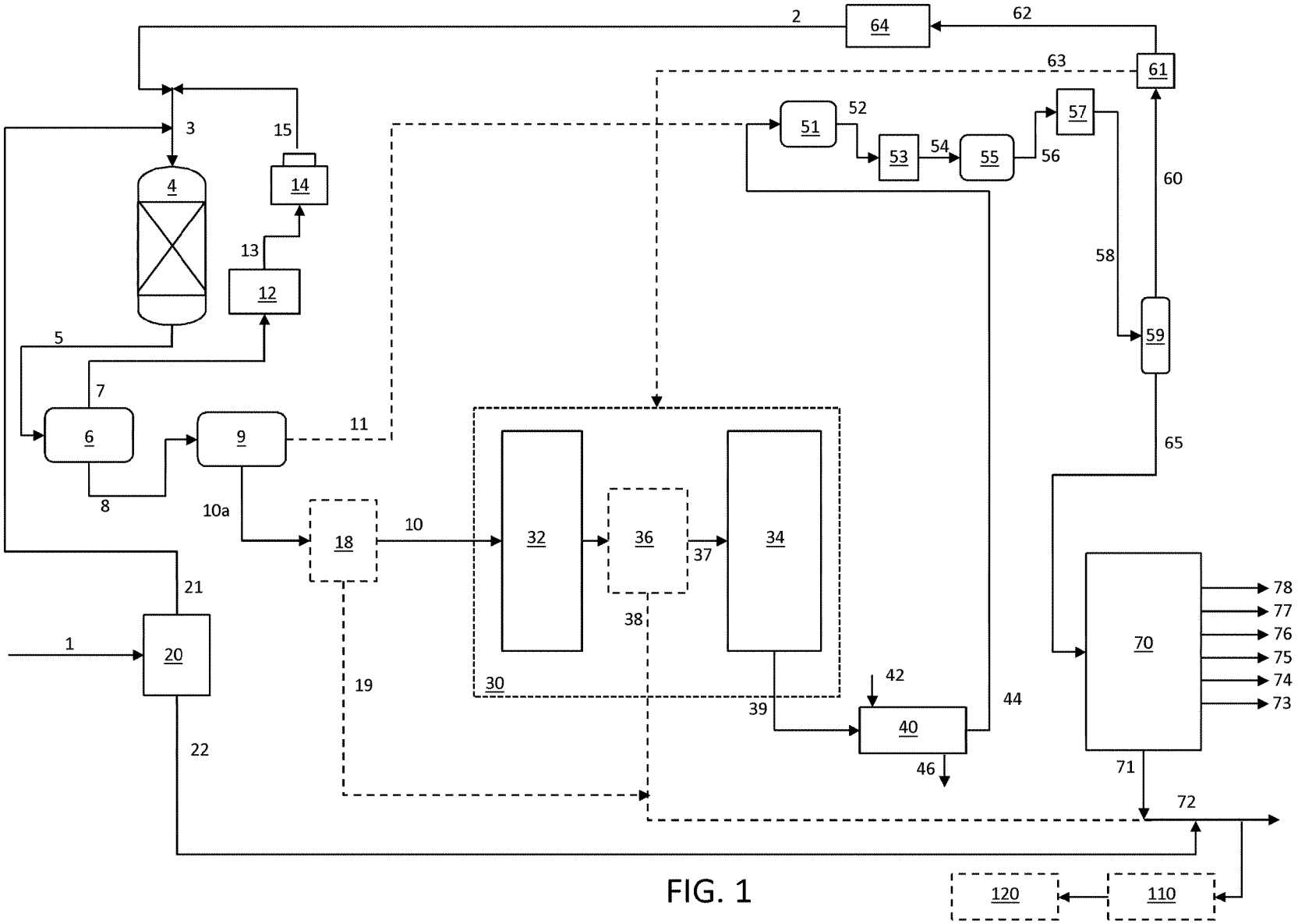
FIG. 1 is a process flow diagram of an embodiment of an integrated process described herein.

A flow diagram including an integrated hydroprocessing and steam pyrolysis process and system including residual bypass is shown in FIG. 1. The integrated system generally includes a feed separation zone, a selective hydroprocessing zone, a steam pyrolysis zone and a product separation zone.

Feed separation zone 20 includes an inlet for receiving a feedstock stream 1, an outlet for discharging a rejected portion 22 and an outlet for discharging a remaining hydrocarbon portion 2. The cut point in separation zone 20 can be set so that it is compatible with the residue fuel oil blend, e.g., about 540° C. Separation zone 20 can be a single stage separation device such a flash separator In additional embodiments separation zone 20 can include, or consists essentially of (i.e., operate in the absence of a flash zone), a cyclonic phase separation device, or other separation device based on physical or mechanical separation of vapors and liquids. One example of a vapor-liquid separation device is illustrated by, and with reference to, FIGS. 2A-2C. A similar arrangement of a vapor-liquid separation device is also described in U.S. Patent Publication Number 2011/0247500 which is incorporated by reference in its entirety herein. In embodiments in which the separation zone includes or consist essentially of a separation device based on physical or mechanical separation of vapors and liquids, the cut point can be adjusted based on vaporization temperature and the fluid velocity of the material entering the device.

Selective hydroprocessing zone includes a hydroprocessing reaction zone 4 having an inlet for receiving a mixture 3 of hydrocarbon portion 21 and hydrogen 2 recycled from the steam pyrolysis product stream and make-up hydrogen as necessary. Hydroprocessing reaction zone 4 further includes an outlet for discharging a hydroprocessed effluent 5.

Reactor effluents 5 from the hydroprocessing reactor(s) are cooled in a heat exchanger (not shown) and sent to a high pressure separator 6. The separator tops 7 are cleaned in an amine unit 12 and a resulting hydrogen rich gas stream 13 is passed to a recycling compressor 14 to be used as a recycle gas 15 in the hydroprocessing reactor. A bottoms stream 8 from the high pressure separator 6, which is in a substantially liquid phase, is cooled and introduced to a low pressure cold separator 9 in which it is separated into a gas stream 11 and a liquid stream 10. Gases from low pressure cold separator include hydrogen, $H_2S$, $NH_3$ and any light hydrocarbons such as $C_1$-$C_4$ hydrocarbons. Typically these gases are sent for further processing such as flare processing or fuel gas processing. According to certain embodiments herein, hydrogen is recovered by combining stream gas stream 11, which includes hydrogen, $H_2S$, $NH_3$ and any light hydrocarbons such as $C_1$-$C_4$ hydrocarbons, with steam cracker products 44. All or a portion of liquid stream 10 serves as the feed to the steam pyrolysis zone 30

Steam pyrolysis zone 30 generally comprises a convection section 32 and a pyrolysis section 34 that can operate based on steam pyrolysis unit operations known in the art, i.e., charging the thermal cracking feed to the convection section in the presence of steam. In addition, in certain optional embodiments as described herein (as indicated with dashed lines in FIG. 1), a vapor-liquid separation section 36 is included between sections 32 and 34. Vapor-liquid separation section 36, through which the heated steam cracking feed from convection section 32 passes, and is fractioned, can be a flash separation device, a separation device based on physical or mechanical separation of vapors and liquids or a combination including at least one of these types of devices. In additional embodiments, a vapor-liquid separation zone 18 is included upstream of sections 32, either in combination with a vapor-liquid separation zone 36 or in the absence of a vapor-liquid separation zone 36. Stream 10*a* is fractioned in separation zone 18, which can be a flash separation device, a separation device based on physical or mechanical separation of vapors and liquids or a combination including at least one of these types of devices.

Useful vapor-liquid separation devices are illustrated by, and with reference to FIGS. 2A-2C and 3A-3C. Similar arrangements of a vapor-liquid separation devices are described in U.S. Patent Publication Number 2011/0247500 which is herein incorporated by reference in its entirety. In this device vapor and liquid flow through in a cyclonic geometry whereby the device operates isothermally and at very low residence time. In general vapor is swirled in a circular pattern to create forces where heavier droplets and liquid are captured and channeled through to a liquid outlet as liquid residue, for instance, which is added to a pyrolysis fuel oil blend, and vapor is channeled through a vapor outlet as the charge 37 to the pyrolysis section 34. In embodiments in which a vapor-liquid separation device 36 is provided, residue 38 is discharged and the vapor is the charge 37 to the pyrolysis section 34. In embodiments in which a vapor-liquid separation device 18 is provided, residue 19 is discharged and the vapor is the charge 10 to the convection section 32. The vaporization temperature and fluid velocity are varied to adjust the approximate temperature cutoff point, for instance in certain embodiments compatible with the residue fuel oil blend, e.g., about 540° C.

Rejected residuals derived from streams 19 and/or 38 have been subjected to the selective hydroprocessing zone and contain a reduced amount of heteroatom compounds including sulfur-containing, nitrogen-containing and metal compounds as compared to the initial feed. This facilitates further processing of these blends, or renders them useful as low sulfur, low nitrogen heavy fuel blends.

A quenching zone 40 includes an inlet in fluid communication with the outlet of steam pyrolysis zone 30 for receiving mixed product stream 39, an inlet for admitting a quenching solution 42, an outlet for discharging the quenched mixed product stream 44 and an outlet for discharging quenching solution 46.

In general, an intermediate quenched mixed product stream 44 is converted into intermediate product stream 65 and hydrogen 62, which is purified in the present process and used as recycle hydrogen stream 2 in the hydroprocessing reaction zone 4. Intermediate product stream 65 is generally fractioned into end-products and residue in separation zone 70, which can be one or multiple separation units such as plural fractionation towers including de-ethanizer, de-propanizer and de-butanizer towers, for example as is known to one of ordinary skill in the art. For example, suitable apparatus are described in "Ethylene," Ullmann's Encyclopedia of Industrial Chemistry, Volume 12, Pages 531-581, in particular FIG. 24, FIG. 25 and FIG. 26, which is incorporated herein by reference.

In general product separation zone 70 includes an inlet in fluid communication with the product stream 65 and plural product outlets 73-78, including an outlet 78 for discharging methane, an outlet 77 for discharging ethylene, an outlet 76 for discharging propylene, an outlet 75 for discharging butadiene, an outlet 74 for discharging mixed butylenes, and an outlet 73 for discharging pyrolysis gasoline. Additionally an outlet is provided for discharging pyrolysis fuel oil 71. The rejected portion 22 from the feed separation zone 20 and optionally the rejected portion 38 from vapor-liquid separation section 36 are combined with pyrolysis fuel oil 71 and the mixed stream can be withdrawn as a pyrolysis fuel oil blend 72, e.g., a low sulfur fuel oil blend to be further processed in an off-site refinery or used as fuel for optional power generation zone 120. Note that while six product outlets are shown, fewer or more can be provided depending, for instance, on the arrangement of separation units employed and the yield and distribution requirements.

An optional power generation zone 120 can be provided, includes an inlet for receiving fuel oil 72 and an outlet for discharging a remaining portion, e.g., a hydrogen deficient sub-standard quality feedstock. An optional fuel gas desulfurization zone 120 includes an inlet for receiving the remaining portion from the power generation zone 110, and an outlet for discharging a desulfurized fuel gas.

In an embodiment of a process employing the arrangement shown in FIG. 1, a crude oil feedstock 1 is introduced into the feed separation zone 20 to produce a rejected portion 22 and a remaining hydrocarbon fraction 21. The hydrocarbon fraction 21 is mixed with an effective amount of hydrogen 2 and 15 (and if necessary a source of make-up hydrogen) to form a combined stream 3 and the admixture 3 is charged to the inlet of selective hydroprocessing reaction zone 4 at a temperature in the range of from 300° C. to 450° C. In certain embodiments, hydroprocessing reaction zone 4 includes one or more unit operations as described in commonly owned United States Patent Publication Number 2011/0083996 and in PCT Patent Application Publication Numbers WO2010/009077, WO2010/009082, WO2010/009089 and WO2009/073436, all of which are incorporated by reference herein in their entireties. For instance, a hydroprocessing zone can include one or more beds containing an effective amount of hydrodemetallization catalyst, and one or more beds containing an effective amount of hydroprocessing catalyst having hydrodearomatization, hydrodenitrogenation, hydrodesulfurization and/or hydrocracking functions. In additional embodiments hydroprocessing zone 200 includes more than two catalyst beds. In further embodiments hydroprocessing reaction zone 4 includes plural reaction vessels each containing one or more catalyst beds, e.g., of different function.

Hydroprocessing reaction zone 4 operates under parameters effective to hydrodemetallize, hydrodearomatize, hydrodenitrogenate, hydrodesulfurize and/or hydrocrack the crude oil feedstock. In certain embodiments, hydroprocessing is carried out using the following conditions: operating temperature in the range of from 300° C. to 450° C.; operating pressure in the range of from 30 bars to 180 bars; and a liquid hour space velocity in the range of from 0.1 $h^{-1}$ to 10 $h^{-1}$. Notably, using crude oil as a feedstock in the hydroprocessing zone advantages are demonstrated, for instance, as compared to the same hydroprocessing unit operation employed for atmospheric residue. For instance, at a start or run temperature in the range of 370° C. to 375° C. the deactivation rate is around 1° C./month. In contrast, if residue were to be processed, the deactivation rate would be closer to about 3° C./month to 4° C./month. The treatment of atmospheric residue typically employs pressure of around 200 bars whereas the present process in which crude oil is treated can operate at a pressure as low as 100 bars. Additionally to achieve the high level of saturation required for the increase in the hydrogen content of the feed, this process can be operated at a high throughput when compared to atmospheric residue. The LHSV can be as high as 0.5 $hr^{-1}$ while that for atmospheric residue is typically 0.25 $hr^{-1}$. An unexpected finding is that the deactivation rate when processing crude oil is going in the inverse direction from that which is usually observed. Deactivation at low throughput (0.25 $hr^{-1}$) is 4.2° C./month and deactivation at higher throughput (0.5 $hr^{-1}$) is 2.0° C./month. With every feed which is considered in the industry, the opposite is observed. This can be attributed to the washing effect of the catalyst.

Reactor effluents 5 from the hydroprocessing zone 4 are cooled in an exchanger (not shown) and sent to a high pressure cold or hot separator 6. Separator tops 7 are cleaned in an amine unit 12 and the resulting hydrogen rich gas stream 13 is passed to a recycling compressor 14 to be used as a recycle gas 15 in the hydroprocessing reaction zone 4. Separator bottoms 8 from the high pressure separator 6, which are in a substantially liquid phase, are cooled and then introduced to a low pressure cold separator 9. Remaining gases, stream 11, including hydrogen, $H_2S$, $NH_3$ and any light hydrocarbons, which can include $C_1$-$C_4$ hydrocarbons, can be conventionally purged from the low pressure cold separator and sent for further processing, such as flare processing or fuel gas processing. In certain embodiments of the present process, hydrogen is recovered by combining stream 11 (as indicated by dashed lines) with the cracking gas, stream 44, from the steam cracker products. The bottoms 10 from the low pressure separator 9 are optionally sent to separation zone 20 or passed directly to steam pyrolysis zone 30.

The hydroprocessed effluent **10*a*** contains a reduced content of contaminants (i.e., metals, sulfur and nitrogen), an increased paraffinicity, reduced BMCI, and an increased American Petroleum Institute (API) gravity.

The hydroprocessed effluent **10*a* is conveyed to the inlet of a convection section 32 as feed 10 in the presence of an effective amount of steam, e.g., admitted via a steam inlet. In additional embodiments as described herein a separation zone 18 is incorporated upstream of the convection section 32 whereby the feed 10 is the light portion of said pyrolysis feed. The steam cracking feed can have, for instance, an initial boiling point corresponding to that of the stream 10*a*** and a final boiling point in the range of about 370° C. to about 600° C.

The steam pyrolysis zone 30 operates under parameters effective to crack effluent **10*a* or a light portion 10 thereof derived from the optional separation zone 18, into desired products, including ethylene, propylene, butadiene, mixed butenes and pyrolysis gasoline. In the convection section 32 the mixture is heated to a predetermined temperature, e.g., using one or more waste heat streams or other suitable heating arrangement. The heated mixture of the pyrolysis feedstream and steam is passed to the pyrolysis section 34 to produce a mixed product stream 39. In certain embodiments the heated mixture of from section 32 is passed through a vapor-liquid separation section 36 in which a portion 38 is rejected as a fuel oil component suitable for blending with pyrolysis fuel oil 71**. In certain embodiments, steam cracking is carried out using the following conditions: a temperature in the range of from 400° C. to 900° C. in the convection section and in the pyrolysis section; a steam-to-hydrocarbon ratio in the convection section in the range of from 0.3:1 to 2:1 (wt.:wt.); and a residence time in the convection section and in the pyrolysis section in the range of from 0.05 seconds to 2 seconds.

Figure 2B:
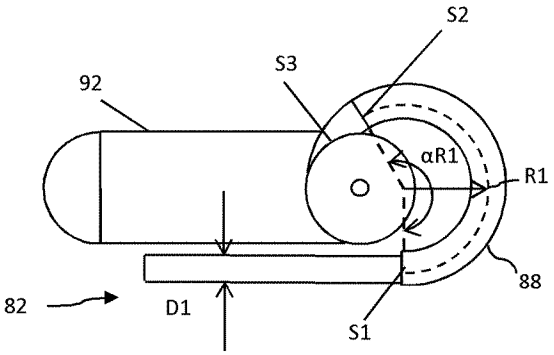
FIGS. 2A-2C are schematic illustrations in perspective, top and side views of a vapor-liquid separation device used in certain embodiments of the integrated process described herein.
Figure 2C:
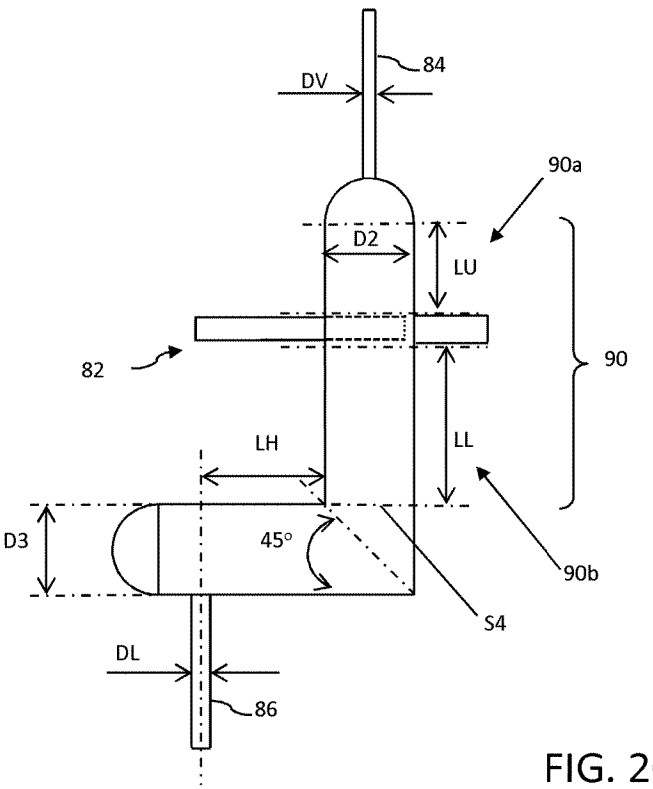
Figure 2A:
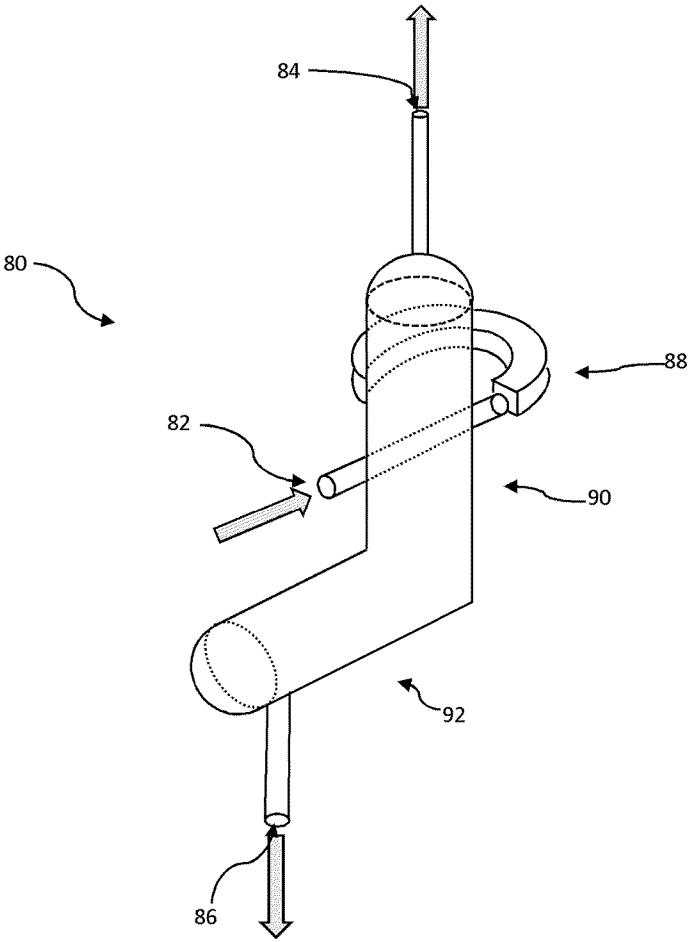

In certain embodiments, the vapor-liquid separation section 36 includes one or a plurality of vapor liquid separation devices 80 as shown in FIGS. 2A-2C. The vapor liquid separation device 80 is economical to operate and maintenance free since it does not require power or chemical supplies. In general, device 80 comprises three ports including an inlet port for receiving a vapor-liquid mixture, a vapor outlet port and a liquid outlet port for discharging and the collection of the separated vapor and liquid, respectively. Device 80 operates based on a combination of phenomena including conversion of the linear velocity of the incoming mixture into a rotational velocity by the global flow pre-rotational section, a controlled centrifugal effect to pre-separate the vapor from liquid (residue), and a cyclonic effect to promote separation of vapor from the liquid (residue). To attain these effects, device 80 includes a pre-rotational section 88, a controlled cyclonic vertical section 90 and a liquid collector/settling section 92.

As shown in FIG. 2B, the pre-rotational section 88 includes a controlled pre-rotational element between cross-section (S1) and cross-section (S2), and a connection element to the controlled cyclonic vertical section 90 and located between cross-section (S2) and cross-section (S3). The vapor liquid mixture coming from inlet 32 having a diameter (D1) enters the apparatus tangentially at the cross-section (S1). The area of the entry section (S1) for the incoming flow is at least 10% of the area of the inlet 82 according to the following equation:

$$\frac{\pi * ([D1])^2}{4} \tag{2}$$

The pre-rotational element 88 defines a curvilinear flow path, and is characterized by constant, decreasing or increasing cross-section from the inlet cross-section S1 to the outlet cross-section S2. The ratio between outlet cross-section from controlled pre-rotational element (S2) and the inlet cross-section (S1) is in certain embodiments in the range of $0.7 \leq S2/S1 \leq 1.4$.

The rotational velocity of the mixture is dependent on the radius of curvature (R1) of the center-line of the pre-rotational element 88 where the center-line is defined as a curvilinear line joining all the center points of successive cross-sectional surfaces of the pre-rotational element 88. In certain embodiments the radius of curvature (R1) is in the range of $2 \leq R1/D1 \leq 6$ with opening angle in the range of $150° \leq \alpha R1 \leq 250°$.

The cross-sectional shape at the inlet section S1, although depicted as generally square, can be a rectangle, a rounded rectangle, a circle, an oval, or other rectilinear, curvilinear or a combination of the aforementioned shapes. In certain embodiments, the shape of the cross-section along the curvilinear path of the pre-rotational element 88 through which the fluid passes progressively changes, for instance, from a generally square shape to a rectangular shape. The progressively changing cross-section of element 88 into a rectangular shape advantageously maximizes the opening area, thus allowing the gas to separate from the liquid mixture at an early stage and to attain a uniform velocity profile and minimize shear stresses in the fluid flow.

The fluid flow from the controlled pre-rotational element 88 from cross-section (S2) passes section (S3) through the connection element to the controlled cyclonic vertical section 90. The connection element includes an opening region that is open and connected to, or integral with, an inlet in the controlled cyclonic vertical section 90. The fluid flow enters the controlled cyclonic vertical section 90 at a high rotational velocity to generate the cyclonic effect. The ratio between connection element outlet cross-section (S3) and inlet cross-section (S2) in certain embodiments is in the range of $2 \leq S3/S1 \leq 5$.

The mixture at a high rotational velocity enters the cyclonic vertical section 90. Kinetic energy is decreased and the vapor separates from the liquid under the cyclonic effect. Cyclones form in the upper level 90*a* and the lower level 90*b* of the cyclonic vertical section 90. In the upper level 90*a*, the mixture is characterized by a high concentration of vapor, while in the lower level 90*b* the mixture is characterized by a high concentration of liquid.

In certain embodiments, the internal diameter D2 of the cyclonic vertical section 90 is within the range of $2 \leq D2/D1 \leq 5$ and can be constant along its height, the length (LU) of the upper portion 90*a* is in the range of $1.2 \leq LU/D2 \leq 3$, and the length (LL) of the lower portion 90*b* is in the range of $2 \leq LL/D2 \leq 5$.

The end of the cyclonic vertical section 90 proximate vapor outlet 84 is connected to a partially open release riser and connected to the pyrolysis section of the steam pyrolysis unit. The diameter (DV) of the partially open release is in certain embodiments in the range of $0.05 \leq DV/D2 \leq 0.4$.

Accordingly, in certain embodiments, and depending on the properties of the incoming mixture, a large volume fraction of the vapor therein exits device 80 from the outlet 84 through the partially open release pipe with a diameter DV. The liquid phase (e.g., residue) with a low or non-existent vapor concentration exits through a bottom portion of the cyclonic vertical section 90 having a cross-sectional area S4, and is collected in the liquid collector and settling pipe 92.

The connection area between the cyclonic vertical section 90 and the liquid collector and settling pipe 92 has an angle in certain embodiment of 90°. In certain embodiments the internal diameter of the liquid collector and settling pipe 92 is in the range of $2 \leq D3/D1 \leq 4$ and is constant across the pipe length, and the length (LH) of the liquid collector and settling pipe 92 is in the range of $1.2 \leq LH/D3 \leq 5$. The liquid with low vapor volume fraction is removed from the apparatus through pipe 86 having a diameter of DL, which in certain embodiments is in the range of $0.05 \leq DL/D3 \leq 0.4$ and located at the bottom or proximate the bottom of the settling pipe.

In certain embodiments, a vapor-liquid separation device is provided similar in operation and structure to device 80 without the liquid collector and settling pipe return portion.

Figure 3C:
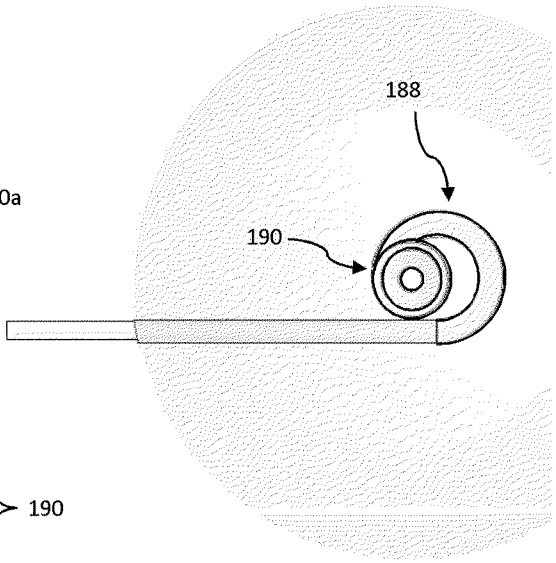
FIGS. 3A-3C are schematic illustrations in section, enlarged section and top section views of a vapor-liquid separation device in a flash vessel used in certain embodiments of the integrated process described herein.
Figure 3B:
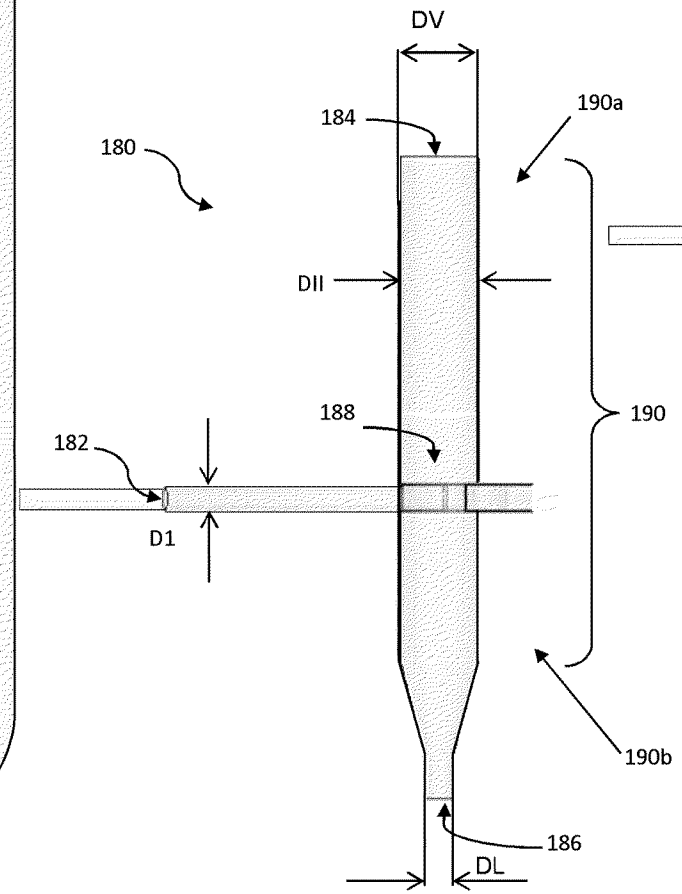
Figure 3A:
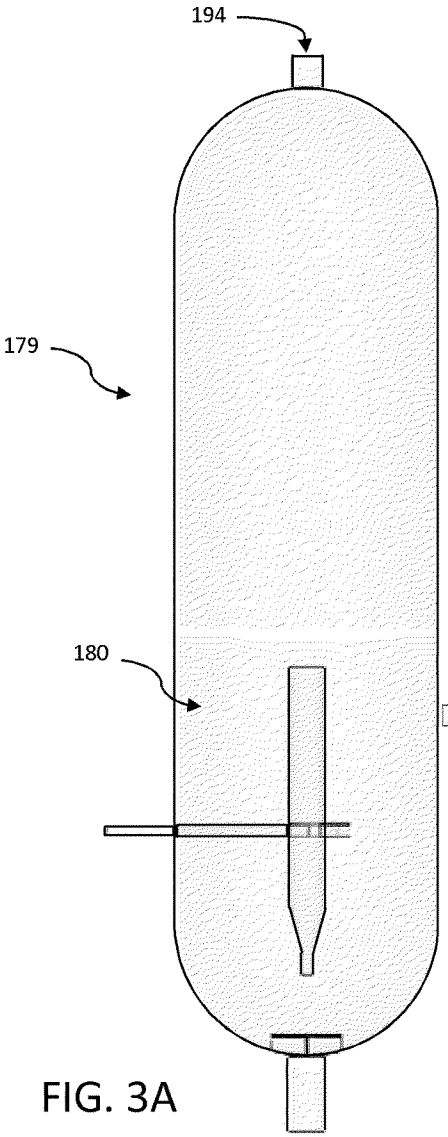

For instance, a vapor-liquid separation device 180 is used as inlet portion of a flash vessel 179, as shown in FIGS. 3A-3C. In these embodiments the bottom of the vessel 179 serves as a collection and settling zone for the recovered liquid portion from device 180.

In general a vapor phase is discharged through the top 194 of the flash vessel 179 and the liquid phase is recovered from the bottom 196 of the flash vessel 179. The vapor-liquid separation device 180 is economical to operate and maintenance free since it does not require power or chemical supplies. Device 180 comprises three ports including an inlet port 182 for receiving a vapor-liquid mixture, a vapor outlet port 184 for discharging separated vapor and a liquid outlet port 186 for discharging separated liquid. Device 180 operates based on a combination of phenomena including conversion of the linear velocity of the incoming mixture into a rotational velocity by the global flow pre-rotational section, a controlled centrifugal effect to pre-separate the vapor from liquid, and a cyclonic effect to promote separation of vapor from the liquid. To attain these effects, device 180 includes a pre-rotational section 188 and a controlled cyclonic vertical section 190 having an upper portion 190*a* and a lower portion 190*b*. The vapor portion having low liquid volume fraction is discharged through the vapor outlet port 184 having a diameter (DV). Upper portion 190*a* which is partially or totally open and has an internal diameter (DII) in certain embodiments in the range of $0.5<DV/DII<1.3$. The liquid portion with low vapor volume fraction is discharged from liquid port 186 having an internal diameter (DL) in certain embodiments in the range of $0.1<DL/DII<1.1$. The liquid portion is collected and discharged from the bottom of flash vessel 179.

In order to enhance and to control phase separation, heating steam can be used in the vapor-liquid separation device 80 or 180, particularly when used as a standalone apparatus or is integrated within the inlet of a flash vessel.

While the various members are described separately and with separate portions, it will be understood by one of ordinary skill in the art that apparatus 80 and apparatus 180 can be formed as a monolithic structure, e.g., it can be cast or molded, or it can be assembled from separate parts, e.g., by welding or otherwise attaching separate components together which may or may not correspond precisely to the members and portions described herein.

It will be appreciated that although various dimensions are set forth as diameters, these values can also be equivalent effective diameters in embodiments in which the components parts are not cylindrical. Mixed product stream 39 is passed to the inlet of quenching zone 40 with a quenching solution 42 (e.g., water and/or pyrolysis fuel oil) introduced via a separate inlet to produce an intermediate quenched mixed product stream 44 having a reduced temperature, e.g., of about 300° C., and spent quenching solution 46 is discharged. The gas mixture effluent 39 from the cracker is typically a mixture of hydrogen, methane, hydrocarbons, carbon dioxide and hydrogen sulfide. After cooling with water or oil quench, mixture 44 is compressed in a multistage compressor zone 51, typically in 4-6 stages to produce a compressed gas mixture 52. The compressed gas mixture 52 is treated in a caustic treatment unit 53 to produce a gas mixture 54 depleted of hydrogen sulfide and carbon dioxide. The gas mixture 54 is further compressed in a compressor zone 55, and the resulting cracked gas 56 typically undergoes a cryogenic treatment in unit 57 to be dehydrated, and is further dried by use of molecular sieves.

The cold cracked gas stream 58 from unit 57 is passed to a de-methanizer tower 59, from which an overhead stream 60 is produced containing hydrogen and methane from the cracked gas stream. The bottoms stream 65 from de-methanizer tower 59 is then sent for further processing in product separation zone 70, comprising fractionation towers including de-ethanizer, de-propanizer and de-butanizer towers. Process configurations with a different sequence of de-methanizer, de-ethanizer, de-propanizer and de-butanizer can also be employed.

According to the processes herein, after separation from methane at the de-methanizer tower 59 and hydrogen recovery in unit 61, hydrogen 62 having a purity of typically 80-95 vol % is obtained. Recovery methods in unit 61 include cryogenic recovery (e.g., at a temperature of about −157° C.). Hydrogen stream 62 is then passed to a hydrogen purification unit 64, such as a pressure swing adsorption (PSA) unit to obtain a hydrogen stream 2 having a purity of 99.9%+, or a membrane separation units to obtain a hydrogen stream 2 with a purity of about 95%. The purified hydrogen stream 2 is then recycled back to serve as a major portion of the requisite hydrogen for the hydroprocessing zone. In addition, a minor proportion can be utilized for the hydrogenation reactions of acetylene, methylacetylene and propadienes (not shown). In addition, according to the processes herein, methane stream 63 can optionally be recycled to the steam cracker to be used as fuel for burners and/or heaters.

The bottoms stream 65 from de-methanizer tower 59 is conveyed to the inlet of product separation zone 70 to be separated into methane, ethylene, propylene, butadiene, mixed butylenes and pyrolysis gasoline discharged via outlets 78, 77, 76, 75, 74 and 73, respectively. Pyrolysis gasoline generally includes C5-C9 hydrocarbons, and benzene, toluene and xylenes can be extracted from this cut. The rejected portion 22 from the feed separation zone 100 and optionally the unvaporized heavy liquid fraction 38 from the vapor-liquid separation section 36 are combined with pyrolysis fuel oil 71 (e.g., materials boiling at a temperature higher than the boiling point of the lowest boiling C10 compound, known as a "C10+" stream) from separation zone 70, and this is withdrawn as a pyrolysis fuel oil blend 72, e.g., to be further processed in an off-site refinery (not shown).

In certain optional embodiments, fuel oil 72 can be passed to power generation zone 110 to generate power (e.g., one or more steam turbines that can employ fuel oil 72 as a fuel source), and a remaining portion is conveyed to a fuel gas desulfurization zone 120 to produce a desulfurized fuel gas.

Advantages of the system described with respect to FIG. 1 include improvements in hydroprocessing, in which the process can be efficiently utilized to improve the hydrogen content of the products. For example, the system described herein uses hydrotreating catalyst having smaller pore size which contributes to significantly more active hydrotreating reactions. In addition, the overall hydrogen consumption of the hydrotreating zone is significantly reduced. Hydrogen is not consumed for upgrading unsatureated heavy residue, but rather is utilized for the fraction undergoing pyrolysis reaction, e.g., fractions boiling below 540° C. The heavier fraction, e.g., boiling above 540° C., is used to generate power for the plant, while the remaining portion is recovered as fuel oil.

In certain embodiments, selective hydroprocessing or hydrotreating processes can increase the paraffin content (or decrease the BMCI) of a feedstock by saturation followed by mild hydrocracking of aromatics, especially polyaromatics. When hydrotreating a crude oil, contaminants such as metals, sulfur and nitrogen can be removed by passing the feedstock through a series of layered catalysts that perform the catalytic functions of demetallization, desulfurization and/or denitrogenation.

In one embodiment, the sequence of catalysts to perform hydrodemetallization (HDM) and hydrodesulfurization (HDS) is as follows:

A hydrodemetallization catalyst. The catalyst in the HDM section are generally based on a gamma alumina support, with a surface area of about 140-240 $m^2/g$. This catalyst is best described as having a very high pore volume, e.g., in excess of 1 $cm^3/g$. The pore size itself is typically predominantly macroporous. This is required to provide a large capacity for the uptake of metals on the catalysts surface and optionally dopants. Typically the active metals on the catalyst surface are sulfides of Nickel and Molybdenum in the ratio Ni/Ni+Mo<0.15. The concentration of Nickel is lower on the HDM catalyst than other catalysts as some Nickel and Vanadium is anticipated to be deposited from the feedstock itself during the removal, acting as catalyst. The dopant used can be one or more of phosphorus (see, e.g., United States Patent Publication Number US 2005/0211603 which is incorporated by reference herein), boron, silicon and halogens. The catalyst can be in the form of alumina extrudates or alumina beads. In certain embodiments alumina beads are used to facilitate un-loading of the catalyst HDM beds in the reactor as the metals uptake will range between 30 to 100% at the top of the bed.

An intermediate catalyst can also be used to perform a transition between the HDM and HDS function. It has intermediate metals loadings and pore size distribution. The catalyst in the HDM/HDS reactor is essentially alumina based support in the form of extrudates, optionally at least one catalytic metal from group VI (e.g., molybdenum and/or tungsten), and/or at least one catalytic metals from group VIII (e.g., nickel and/or cobalt). The catalyst also contains optionally at least one dopant selected from boron, phosphorous, halogens and silicon. Physical properties include a surface area of about 140-200 $m^2/g$, a pore volume of at least 0.6 $cm^3/g$ and pores which are mesoporous and in the range of 12 to 50 nm.

The catalyst in the HDS section can include those having gamma alumina based support materials, with typical surface area towards the higher end of the HDM range, e.g. about ranging from 180-240 $m^2/g$. This required higher surface for HDS results in relatively smaller pore volume, e.g., lower than 1 $cm^3/g$. The catalyst contains at least one element from group VI, such as molybdenum and at least one element from group VIII, such as nickel. The catalyst also comprises at least one dopant selected from boron, phosphorous, silicon and halogens. In certain embodiments cobalt is used to provide relatively higher levels of desulfurization. The metals loading for the active phase is higher as the required activity is higher, such that the molar ratio of Ni/Ni+Mo is in the range of from 0.1 to 0.3 and the (Co+Ni)/Mo molar ratio is in the range of from 0.25 to 0.85.

A final catalyst (which could optionally replace the second and third catalyst) is designed to perform hydrogenation of the feedstock (rather than a primary function of hydrodesulfurization), for instance as described in Appl. Catal. A General, 204 (2000) 251. The catalyst will be also promoted by Ni and the support will be wide pore gamma alumina. Physical properties include a surface area towards the higher end of the HDM range, e.g., 180-240 $m^2/g$ gr. This required higher surface for HDS results in relatively smaller pore volume, e.g., lower than 1 $cm^3/g$.

The method and system herein provides improvements over known steam pyrolysis cracking processes:

use of crude oil as a feedstock to produce petrochemicals such as olefins and aromatics;

the hydrogen content of the feed to the steam pyrolysis zone is enriched for high yield of olefins;

coke precursors are significantly removed from the initial whole crude oil which allows a decreased coke formation in the radiant coil; and additional impurities such as metals, sulfur and nitrogen compounds are also significantly removed from the starting feed which avoids post treatments of the final products.

In addition, hydrogen produced from the steam cracking zone is recycled to the hydroprocessing zone to minimize the demand for fresh hydrogen. In certain embodiments the integrated systems described herein only require fresh hydrogen to initiate the operation. Once the reaction reaches the equilibrium, the hydrogen purification system can provide enough high purity hydrogen to maintain the operation of the entire system.

The method and system of the present invention have been described above and in the attached drawings; however, modifications will be apparent to those of ordinary skill in the art and the scope of protection for the invention is to be defined by the claims that follow.

The invention claimed is:

1. An integrated hydrotreating and steam pyrolysis process for the direct processing of a crude oil to produce olefinic and aromatic petrochemicals, the process comprising:

a. separating the crude oil into light components and heavy components, wherein the heavy components corresponds to a residue fuel oil blend and the light components are remaining hydrocarbons from the crude oil that are lighter than the residue fuel oil blend;

b. charging the light components and hydrogen to a reactor of a catalytic hydroprocessing zone, the reactor operating under conditions effective to produce a hydroprocessed effluent;

c. separating the hydroprocessed effluent in a high pressure separator to recover a gas portion that is cleaned and recycled to the reactor of the catalytic hydroprocessing zone as an additional source of hydrogen, and a liquid portion, d. separating the liquid portion from the high pressure separator in a low pressure separator into a gas portion and a liquid portion;

e. thermally cracking the liquid portion from the low pressure separator in the presence of steam in a steam pyrolysis zone to produce a mixed product stream, f. charging the thermally cracked mixed product stream to a quenching zone to produce an intermediate quenched mixed product stream;

g. separating the quenched mixed product stream;

h. purifying hydrogen recovered in step (g) and recycling it to the reactor of the catalytic hydroprocessing zone;

i. recovering olefins and aromatics from the separated mixed product stream; and j. recovering pyrolysis fuel oil from the separated mixed product stream.

2. The integrated process of claim 1 wherein the thermal cracking step comprises heating hydroprocessed effluent in a convection section of a steam pyrolysis zone, separating the heated hydroprocessed effluent into a vapor fraction and a liquid fraction, passing the vapor fraction to a pyrolysis section of a steam pyrolysis zone, and discharging the liquid fraction.

3. The integrated process of claim 2, wherein the discharged liquid fraction separated from the heated hydroprocessed effluent is blended with pyrolysis fuel oil recovered in step (j).

4. The integrated process of claim 2, wherein separating the heated hydroprocessed effluent into a vapor fraction and a liquid fraction is with a vapor-liquid separation device based on physical and mechanical separation.

5. The integrated process of claim 1, wherein step (g) comprises compressing the thermally cracked mixed product stream with plural compression stages;

subjecting the compressed thermally cracked mixed product stream to caustic treatment to produce a thermally cracked mixed product stream with a reduced content of hydrogen sulfide and carbon dioxide;

compressing the thermally cracked mixed product stream with a reduced content of hydrogen sulfide and carbon dioxide;

dehydrating the compressed thermally cracked mixed product stream with a reduced content of hydrogen sulfide and carbon dioxide;

recovering hydrogen from the dehydrated compressed thermally cracked mixed product stream with a reduced content of hydrogen sulfide and carbon dioxide; and obtaining olefins and aromatics as in step (i) and pyrolysis fuel oil as in step (j) from the remainder of the dehydrated compressed thermally cracked mixed product stream with a reduced content of hydrogen sulfide and carbon dioxide; and step (h) comprises purifying recovered hydrogen from the dehydrated compressed thermally cracked mixed product stream with a reduced content of hydrogen sulfide and carbon dioxide for recycle to the hydroprocessing zone.

6. The integrated process of claim 5, wherein recovering hydrogen from the dehydrated compressed thermally cracked mixed product stream with a reduced content of hydrogen sulfide and carbon dioxide further comprises separately recovering methane for use as fuel for burners and/or heaters in the thermal cracking step.

7. The integrated process of claim 1, further comprising separating the liquid portion from the low pressure separator of the hydroprocessed effluent into a heavy fraction and a light fraction in a hydroprocessed effluent separation zone, wherein the light fraction is the thermal cracking feed used in step (e), and blending the heavy fraction with pyrolysis fuel oil recovered in step (j).

8. The integrated process of claim 7, wherein the hydroprocessed effluent separation zone is a flash separation apparatus.

9. The integrated process of claim 7, wherein the hydroprocessed effluent separation zone is a physical or mechanical apparatus for separation of vapors and liquids.

10. The integrated process of claim 7, wherein the hydroprocessed effluent separation zone comprises a flash vessel having at its inlet a physical or mechanical apparatus for separation of vapors and liquids.

11. The process of claim 1, wherein fresh hydrogen is used to initiate the process, and further wherein the hydrogen produced and recycled in step (h) provides sufficient hydrogen to the reactor of the catalytic hydroprocessing zone when the reaction reaches equilibrium.

12. The process of claim 1, wherein the heavy components from step (a) is blended with pyrolysis fuel oil recovered in step (j).

13. The process of claim 1, wherein the low pressure separator is a low pressure cold separator.

14. The process of claim 1, wherein the gas portion from the low pressure separator is combined with the intermediate quenched mixed product stream.

* * * * *